United States Patent [19]

Jautelat et al.

[11] Patent Number: 5,002,027

[45] Date of Patent: Mar. 26, 1991

[54] METHOD FOR CONTROLLING THE NO-LOAD SPEED OF AN INTERNAL COMBUSTION ENGINE

[75] Inventors: Rüdiger Jautelat, Tamm; Rolf Kohler, Schwieberdingen; Cornelius Peter, Ottersweier; Günther Plapp, Filderstadt; Martin Stilling, Stuttgart, all of Fed. Rep. of Germany

[73] Assignee: Robert Bosch GmbH, Stuttgart, Fed. Rep. of Germany

[21] Appl. No.: 410,586

[22] Filed: Sep. 21, 1989

Related U.S. Application Data

[63] Continuation-in-part of Ser. No. 21,009, Jan. 20, 1987, abandoned.

[30] Foreign Application Priority Data

May 18, 1985 [DE] Fed. Rep. of Germany ..... 3518014

[51] Int. Cl.[5] ..... F02D 41/16

[52] U.S. Cl. ..... 123/339

[58] Field of Search ..... 123/339, 361

[56] References Cited

U.S. PATENT DOCUMENTS

| | | | |
|---|---|---|---|
| 3,964,457 | 6/1976 | Coscia | 123/339 X |
| 4,297,978 | 11/1981 | Matsui | 123/339 |
| 4,344,399 | 8/1982 | Matsumura et al. | 123/339 |
| 4,359,983 | 11/1982 | Carlson et al. | 123/339 |
| 4,365,599 | 12/1982 | Ikeura | 123/399 |
| 4,453,518 | 6/1984 | Nakamura et al. | 123/361 |
| 4,601,276 | 7/1986 | Damson et al. | 123/489 |

*Primary Examiner*—Tony M. Argenbright

*Attorney, Agent, or Firm*—Walter Ottesen

[57] ABSTRACT

The invention is directed to a method for controlling the no-load speed of an internal combustion engine wherein the position of the throttle flap in the intake tube of the engine is varied as a function of the speed of the engine and of a position signal defining the position of the throttle flap. The variation of the throttle flap position takes place, however, only whenever the throttle flap has assumed a specific, predeterminable position and whenever the engine speed has remained virtually constant over a likewise predeterminable period of time. An embodiment in the form of a flow chart is described by means of which the method according to the invention can be realized.

8 Claims, 3 Drawing Sheets

METHOD FOR CONTROLLING THE NO-LOAD SPEED OF AN INTERNAL COMBUSTION ENGINE

RELATED APPLICATION

This is a continuation-in-part of application Ser. No. 021,009, filed on Jan. 20, 1987 and entitled "Method for Controlling the No-Load Speed of an Internal Combustion Engine", now abandoned.

FIELD OF THE INVENTION

The invention relates to a method for controlling the no-load (idle) speed of an internal combustion engine with the engine including: a throttle flap in the intake tube of the engine; a device for adjusting the throttle flap as a function of an electrical control signal; a device for detecting at least one specific position of the throttle flap and for generating a corresponding electrical position signal; a device for detecting the speed of the engine; and, an electrical control unit for generating the control signal at least as a function of the position signal and the speed signal.

BACKGROUND OF THE INVENTION

From U.S. Pat. No. 3,964.,457, it is known to vary the no-load speed of an internal combustion engine by adjusting the throttle flap. For this purpose, first, a throttle flap switch is connected to the throttle flap, indicating the no-load position of the throttle flap, and an electrically adjustable cam is provided, with the aid of which this no-load position and hence the position of the throttle flap can be varied. As can also be learned from the aforementioned patent, the cam is acted upon in accordance with the no-load position of the throttle flap and with the speed of the engine.

The disadvantage of the above-described known apparatus is that in the no-load situation a continuous variation of the cam and hence of the position of the throttle flap occurs, so that the no-load speed also continuously varies slightly. Such fluctuations in the no-load speed are undesirable, however, because they impede smooth operation of the engine.

SUMMARY OF THE INVENTION

In comparison with the known prior art, the invention has the advantage that fluctuations of the no-load speed are suppressed in an optimal manner. This is accomplished in that the position of the throttle flap can be varied only whenever the throttle flap has assumed the specific position and the engine speed has previously remained virtually constant for a pregiven period of time. In this way, a control of the no-load speed then occurs only when at least both conditions are fulfilled. If this is not the case, the no-load speed is maintained by other measures such as the following: controlling the air supply as described in U.S. Pat. No. 3,964,457; controlling the ignition; or, controlling the fuel metered to the engine.

In a particularly advantageous embodiment of the invention, the specific throttle flap position is the stop of the throttle flap in the no-load position. In that case, in a further particularly advantageous embodiment of the invention, the adjustment of the throttle flap can be effected by adjusting this stop. With these measures, it is attained that the device for adjusting the throttle flap and the device for detecting the specific position of the throttle flap can be realized with the aid of a simple combination component.

In a further particularly advantageous feature of the invention, the variation of the position of the throttle flap is made additionally dependent on at least one of the following conditions, namely, that the overrun shut-off means is not switched on, that the engine is not cold, that the engine is not overly hot, and that a specific, pregiven period of time has elapsed since the last variation of the throttle flap. As a result, the no-load operating state is reliably recognized and special operating conditions of the engine can be taken into account.

A further advantage is realized in that the operating condition for controlling the no-load speed (the stable no-load condition) is then recognized when the course of the speed of the engine has remained constant for a predetermined time duration and this operating condition is seen as ended when at least the speed (rpm) has gone through a large change compared to a predetermined threshold.

BRIEF DESCRIPTION OF THE DRAWINGS

The invention will now be described with reference to the drawings wherein.

DESCRIPTION OF THE PREFERRED EMBODIMENTS OF THE INVENTION

The exemplary embodiment described below can be used in connection with internal combustion engines, especially in connection with Otto engines. The exemplary embodiment is described in the form of a flow chart, but it is also possible for the entire apparatus to be realized with the aid of a corresponding electrical circuit, for instance an analog electrical circuit.

Figure 1:
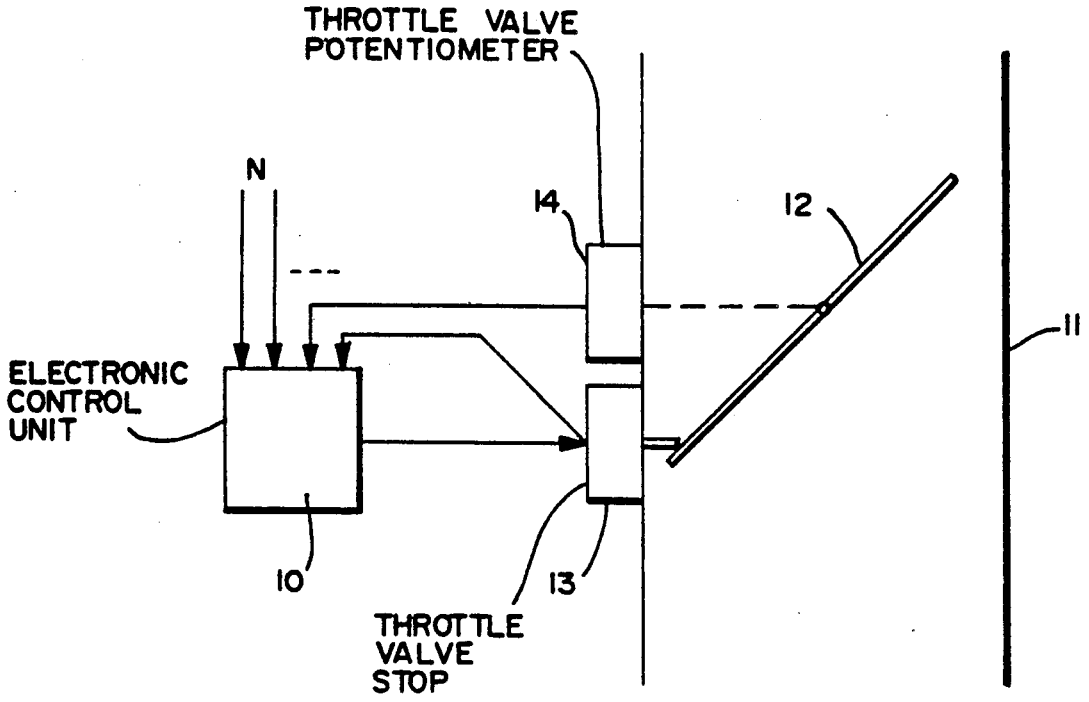
FIG. 1 is a simplified schematic of the apparatus for carrying out the method of the invention.

In FIG. 1, an electronic control unit 10, as a function of a plurality of input signals, generates an output signal that triggers an adjustable throttle flap stop 13 of a throttle flap 12 disposed in the intake tube 11 of an internal combustion engine. With the aid of a throttle flap potentiometer 14 coupled to this throttle flap 12, and by means of the throttle flap stop 13, signals are generated that are supplied as input signals to the electronic control unit 10, and which serve as feedback signals for the position of the throttle flap 12 in the intake tube 11 of the engine. With the aid of the arrangement shown in FIG. 1, the stop position of the throttle flap 12 can be varied via the adjustable throttle flap stop 13, this variation being brought about by the output signal generated by the electronic control unit 10, and this output signal, in turn, being dependent at least on the output signal of the throttle flap potentiometer 14 or on the output signal of the throttle flap stop 13.

Figure 2:
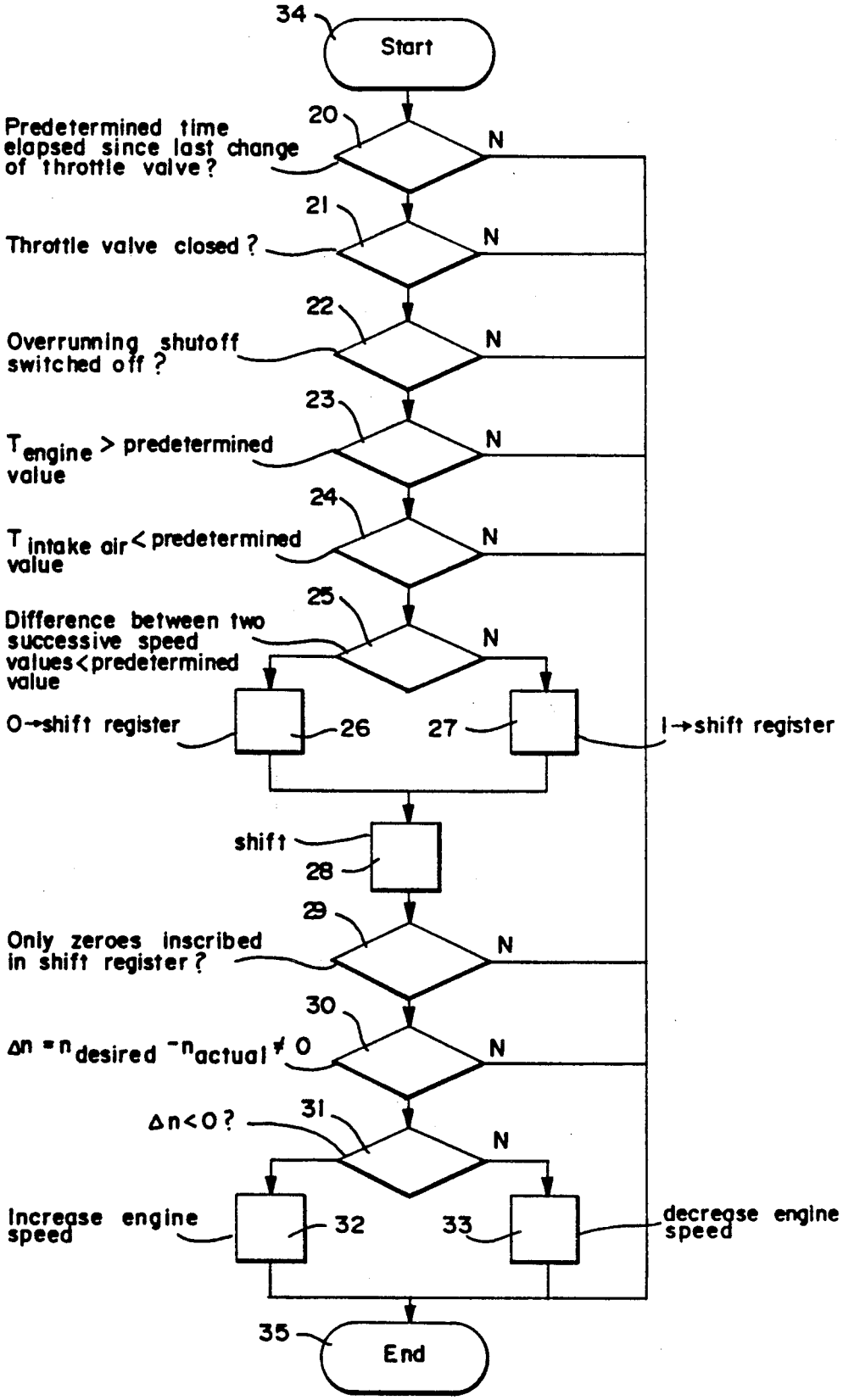
FIG. 2 is a flow chart of the method according to the invention, which can be realized with the aid of the apparatus shown in FIG. 1; and, FIG. 3 is a graph of the engine idling (no-load) speed as a function of time and shows advantageous effects of the method according to the invention.

FIG. 2 shows a flow chart of the method according to the invention, with the aid of which the change of the throttle flap stop is brought about, and which can be realized with the aid of the apparatus of FIG. 1.

Reference numerals 34 and 35 in FIG. 2 represent the start and end of the method according to the invention. This means that the flow chart shown in FIG. 2 is started, for example, in a fixedly predetermined time reference, or as a function of specific conditions or occurrences.

In the decision block 20 following the start block 34, it is first checked as to whether a specific, predeterminable time has already elapsed since the last change of the throttle flap by the method according to the invention. If such is not the case, then the method is terminated directly, via the end block 35. However, if the time has elapsed, then in the 10 following decision block it is checked as to whether the throttle flap is closed. This checking is, for example, done by means of the throttle flap stop 13, which, for example, furnishes an output signal to the electronic control unit 10 only whenever the throttle flap is closed. In the negative case, the method according to the invention is terminated, as in the decision block 20, while in the positive case, that is, if the throttle flap is closed, the method is continued with the decision block 22. There, it is checked as to whether the overrun shutoff mean is switched off. If that is not the case, then the method is again terminated, but if the overrun shutoff means is indeed switched off, then it is checked in the following decision blocks 23 and 24 as to whether specific temperature conditions are satisfied.

In block 23, it is checked whether the engine temperature is higher than 80° C., for example, while contrarily in block 24 it is checked as to whether the intake air temperature is lower than 60° C., for example. If one of these two checks yields a negative result, then the method is terminated, as already noted; contrarily, if the result is positive, then the method is continued, after block 24, with the decision block 25. There, the difference between the actual speed value and the most recently measured speed value is calculated and checked as to whether this difference is below a specific predeterminable value. If that is the case, then the method is continued with block 26; if not, the method is continued with block 27.

In block 26, or in other words if the difference between the actual and the most recently measured speed value is less than the predetermined value, a digital zero is inscribed in a shift register especially reserved for this, while in the case of block 27 a 1 is inscribed in the same location of the shift register. The flow chart continues, after blocks 26 and 27, with block 28 in either case, with the aid of which the digital values inscribed in the shift register are shifted by one place. After block 28, the method according to the invention is continued with the decision block 29, by checking whether only digital zeroes are inscribed in the shift register, or in other words no ones have been inscribed. If this is the case, then it is checked in decision block 30 as to whether the difference between the actually filtered speed value (short-term mea value) and a predeterminable no-load desired speed is not equal to zero. If the two above-mentioned speed values are equal, then the method according to the invention is terminated, as is also the case 25 if the shift register contains a 1. However, if there is a difference between the actual speed value and the predetermined no-load desired value, then in the following decision block 31 it is checked whether this difference is less than zero. If it is less than zero, then in block 32 the throttle flap in the intake tube of the engine is acted upon such that the speed of the engine increases. In contrast, if the difference is greater than zero or in other words if the actual speed value is greater than the no-load desired value, then the position of the throttle flap is acted upon such that the engine speed decreases; that is, the adjustable throttle flap stop 13 is acted upon such that the throttle flap 12 closes to a greater extent. With the adjustments of the throttle flap 12 via the throttle flap stop 13 as described above, the signal generated by the throttle flap potentiometer 14 serves as a feedback for the position or adjustment of the throttle flap 12. Once block 32 or block 33 has been completed, the method according to the invention is terminated as recited above.

All the checks performed in the course of the method according to the invention are dependent on arbitrary input signals, which are available to the electronic control unit that performs the method. Examples of such input signals are a signal relating to the activity of the overrun shutoff means, an engine temperature signal, an intake air temperature signal, a signal relating to the actual engine speed, and the like. The no-load desired speed, as well as the comparison values required for the method, can be furnished in any arbitrary manner inside the control unit, and can also be dependent in turn on any arbitrary engine operating characteristics. Finally, in the case of blocks 32 and 33 the control unit generates an output signal that acts upon the throttle flap, for example, in such a way that each time the method according to the invention is performed, the throttle flap can be adjusted by a maximum of one predeterminable unit of variation.

With the aid of the decision blocks 20 to 24, the no-load operating state is reliably recognized. To this end, checking is done as to whether the throttle flap is closed (21) and as to whether at the same time the overrun shutoff means is switched off (22). Only when these conditions are present is the engine in a no-load state. To enable taking special operating conditions of the engine into account as well, checking is also done as to whether the warmup phase of the engine has ended (23) and whether at the same time no hot-starting conditions are present (24). Block 20 has the task of intentionally varying the frequency of performance of the method according to the invention, and as a result, the method according to the invention can be adapted to given tasks and conditions of use.

With the aid of blocks 25 to 29, it is attained that the method according to the invention does not act continuously upon the throttle flap, but instead only whenever the engine speed has remained virtually constant for a predeterminable period of time. To this end, in block 25 the difference between two successive speed values is measured and compared with a predetermined value, so that in block 29 it can then be ascertained whether the engine speed has remained constant or not. If the difference between two successive speed values exceeds a specific predetermined value, then a 1 is inscribed in the shift register, with the result that at least for a specific time this 1 is maintained in the shift register. However, as long as there is a 1 in the shift register, the throttle flap is not varied. To summarize, then, a change takes place only if a 1 previously inscribed in the shift register has been pushed out of the shift register again by the shifting into block 28 and the entire shift register is accordingly occupied by zeroes.

Figure 3:
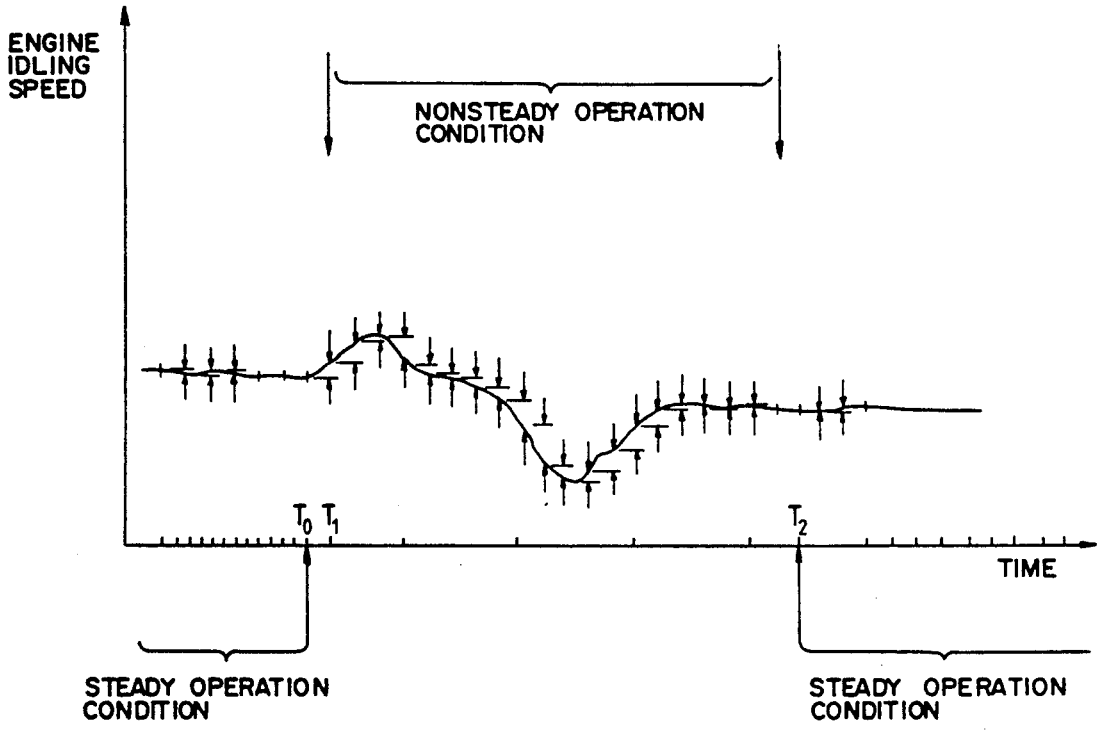

The diagram of FIG. 3 shows the advantageous effects of the method according to the invention with the aid of an example of the course of the speed of the engine as a function of time. With each program run, the difference of the instantaneous speed value and the speed value determined in the previous program run is formed and compared to a threshold value. The differences are stored for a predetermined number of program runs. If all stored differences are beneath the threshold value, then a stable no-load condition is recognized; that is, a stable no-load condition is recognized when the values representing the differences are below this threshold value.

Referring to FIG. 3, at the time $T_0$, the difference exceeds the threshold value in the course of the program run $T_0$ to $T_l$. Then, instantaneously, a nonsteady or transient condition is recognized and the control is dispensed with. Only at time $T_2$ and after a predetermined number of difference values lie below the threshold, is a steady operating condition again detected. This means that the operating condition for controlling the no-load speed is then recognized when at least the speed of the engine has remained approximately constant over a predetermined time duration. More specifically, the course of the speed (rpm) has remained constant for a predetermined time and this operating condition is viewed as being ended when at least the speed of the engine goes through a large change compared to a predetermined threshold.

Finally, before the throttle flap is acted upon, a check is also made as to whether the predetermined no-load speed of the engine deviates at all from the actual speed value. If this is in fact not the case, then no change of the throttle flap position is necessary, and therefore none is performed. If the desired and actual speed values are not the same, however, then with the aid of blocks 32 and 33, the throttle flap is adjusted such that the difference between the two speed values decreases.

In principle, by using suitable rapidly adjusting throttle flap stops 13, it is possible to design a complete no-load speed control with the aid of the method according to the invention. It is also possible, however, to use the method according to the invention only as an adaptation method, or in other words to compensate for changes that elapse slowly and cannot be compensated for with the aid of, for instance, a superimposed no-load speed control. Slow changes of this kind include, for example, engine aging phenomena, environmental parameters, altitude errors, and the like.

It is understood that the foregoing description is that of the preferred embodiments of the invention and that various changes and modifications may be made thereto without departing from the spirit and scope of the invention as defined in the appended claims.

What is claimed is:

1. Method for controlling the no-load rotational speed of an internal combustion engine wherein a no-load operating condition is reliably detected while taking special operating conditions into account, the engine having a throttle flap mounted in the air-intake pipe and a device for displacing the throttle flap in dependence upon an electrical control signal; the method comprising the steps of:

detecting at least one specific position of the throttle flap and generating an electrical position signal corresponding thereto;

detecting the rotational speed of the engine and generating a detected speed signal corresponding thereto;

comparing said detected comparison signal indicative of the result of the comparison;

generating a control signal with an electrical control device at least in dependence upon said position signal and said speed comparison signal;

checking the operational condition for the control of the no-load speed with the aid of sequential speed values;

detecting the operational condition for controlling the no-load speed when a determination is made on the basis of several sequential speed values that the speed of the engine has remained substantially constant for a pregiven time duration; and, determining the end of the operational condition for controlling the no-load speed when a determination is made on the basis of two sequential speed values that the speed of the engine goes through a change which is large when compared to a pregiven threshold.

2. The method of claim 1, wherein the position of the throttle flap can be changed when the overrun shutoff is not switched in.

3. The method of claim 1, wherein the position of the throttle flap can be changed when the engine is no longer cold.

4. The method of claim 1, wherein the position of the throttle flap can be changed when the engine is not too hot.

5. The method of claim 1, wherein the position of the throttle flap can be changed when the rotational speed of the engine deviates from a predetermined idle desired speed value.

6. The method of claim 1, wherein the position of the throttle flap can be changed after a specific, predetermined length of time has elasped since the last change in position of the throttle flap.

7. The method of claim 1, wherein the throttle flap is opened further when the speed of the engine is less than a predetermined desired speed value and wherein the throttle flap is closed when the speed of the engine is greater than a predetermined desired speed value.

8. The method of claim 1, wherein the actual course of the speed of the engine is examined in retrospect for a pregiven time duration with the aid of a shift register.

* * * * *

UNITED STATES PATENT AND TRADEMARK OFFICE

CERTIFICATE OF CORRECTION

PATENT NO. : 5,002,027

DATED : March 26, 1991

INVENTOR(S) : Rüdiger Jautelat, Rolf Kohler, Cornelius Peter, Günther Plapp and Martin Stilling It is certified that error appears in the above-identified patent and that said Letters Patent is hereby corrected as shown below:

In column 1, line 27: delete "No. 3,964.,457" and substitute -- No. 3,964,457 -- therefor.

In column 3, line 9, after "the", delete "10".

In column 3, line 19: delete "mean" and substitute -- means -- therefor.

In column 3, line 54: delete "mea"and substitute -- mean -- therefor.

In column 3, line 58, after "case", delete "25".

In column 5, line 9: delete "$T_?$"and substitute -- $T_1$ -- therefor.

UNITED STATES PATENT AND TRADEMARK OFFICE

CERTIFICATE OF CORRECTION

PATENT NO. : 5,002,027

DATED : March 26, 1991

INVENTOR(S) : Rüdiger Jautelat, Rolf Kohler, Cornelius Peter, Günther Plapp and Martin Stilling It is certified that error appears in the above-identified patent and that said Letters Patent is hereby corrected as shown below:

In column 6, line 1: delete ";"and substitute -- , -- therefor.

In column 6, line 9, between "detected" and "comparison", insert -- speed signal to a predetermined speed signal to form a speed --.

Signed and Sealed this

Twenty-fifth Day of May, 1993

Michael K. Kirk

*Attest:*

MICHAEL K. KIRK

*Attesting Officer*

*Acting Commissioner of Patents and Trademarks*